US009444207B1

(12) United States Patent
Smith

(10) Patent No.: US 9,444,207 B1
(45) Date of Patent: Sep. 13, 2016

(54) ERGONOMIC VEHICLE TRAILER ELECTRICAL CONNECTOR AND CIRCUIT INDICATOR

(71) Applicant: Steve Smith, Early, TX (US)

(72) Inventor: Steve Smith, Early, TX (US)

( * ) Notice: Subject to any disclaimer, the term of this patent is extended or adjusted under 35 U.S.C. 154(b) by 0 days.

(21) Appl. No.: 14/731,322

(22) Filed: Jun. 4, 2015

(51) Int. Cl.

| | |
|---|---|
| ***H01R 31/00*** | (2006.01) |
| ***H01R 27/02*** | (2006.01) |
| ***H01R 31/06*** | (2006.01) |
| *H01R 103/00* | (2006.01) |
| *H01R 24/00* | (2011.01) |

(52) U.S. Cl.
CPC ..... *H01R 27/02* (2013.01); *H01R 31/06* (2013.01); *H01R 31/065* (2013.01); *H01R 23/025* (2013.01); *H01R 2103/00* (2013.01); *H01R 2201/26* (2013.01)

(58) Field of Classification Search
CPC .. H01R 31/06; H01R 23/025; H01R 31/065; H01R 27/02; H01R 2103/00
USPC ..... 439/638, 639, 35
See application file for complete search history.

(56) References Cited

U.S. PATENT DOCUMENTS

| | | | | | |
|---|---|---|---|---|---|
| 3,004,217 | A | * | 10/1961 | Ciardiello | F21L 7/00 324/507 |
| 3,836,843 | A | | 9/1974 | Yonce | |
| 4,005,922 | A | * | 2/1977 | Burkhart | H01R 13/512 439/465 |
| 4,430,637 | A | | 2/1984 | Koch-Ducker et al. | |
| 4,671,597 | A | | 6/1987 | Grill | |
| 4,772,209 | A | * | 9/1988 | Muncey | H01R 33/92 313/318.01 |
| 4,842,524 | A | | 6/1989 | Hopkins et al. | |
| 5,080,594 | A | | 1/1992 | Swinford | |
| 5,184,960 | A | | 2/1993 | Hopkins et al. | |
| D335,122 | S | | 4/1993 | Hughes | |
| 5,354,204 | A | * | 10/1994 | Hughes | B60D 1/64 439/35 |
| 5,380,209 | A | | 1/1995 | Converse, Jr. et al. | |
| 5,414,362 | A | | 5/1995 | Gramling et al. | |
| 5,443,389 | A | * | 8/1995 | Hughes | B60D 1/62 439/35 |
| D370,204 | S | | 5/1996 | Kittridge | |
| 5,575,675 | A | | 11/1996 | Endo et al. | |
| 5,604,439 | A | | 2/1997 | Walkington et al. | |
| 5,611,695 | A | * | 3/1997 | Bentley | B60D 1/64 439/131 |
| 5,626,479 | A | * | 5/1997 | Hughes | B60D 1/62 439/35 |
| 6,259,170 | B1 | | 7/2001 | Limoge et al. | |
| 6,447,302 | B1 | * | 9/2002 | Davis | H01R 29/00 439/34 |
| D468,691 | S | | 1/2003 | Detter et al. | |
| 6,558,167 | B2 | * | 5/2003 | Harmon | B60D 1/62 439/35 |
| 6,642,628 | B2 | * | 11/2003 | Burdick | B60D 1/62 307/10.1 |
| 6,695,621 | B1 | * | 2/2004 | Wang | H01R 13/447 439/35 |
| 6,749,438 | B1 | * | 6/2004 | Scheller | B60D 1/62 439/35 |

(Continued)

*Primary Examiner* — Chandrika Prasad
*Assistant Examiner* — Vladimir Imas
(74) *Attorney, Agent, or Firm* — Kammer Browning PLLC

(57) ABSTRACT

An ergonomic electrical connector and circuit indicator that facilitates the establishment of electrical connections between a motor vehicle and a towed trailer. The connector body has a first end portion configured appropriately for engaging a vehicle connector socket or plug. A second end portion of the connector defines an upwardly curved and expanded cylindrical section that presents an open connector face with an array of electrical connections and an associated array of LED indicators. The upward orientation eliminates the need for the user to work with the horizontal connector face at ground level and provides easy access to each of the terminals to which trailer wires are attached. The aligned LED indicators are each associated with a particular electrical terminal. The LED indicators therefore provide an identification of a particular circuit and the operational functionality of that circuit.

12 Claims, 3 Drawing Sheets

(56) References Cited

U.S. PATENT DOCUMENTS

| | | | | |
|---|---|---|---|---|
| 7,118,379 | B1 * | 10/2006 | Wang | H01R 13/6641 439/35 |
| 7,291,017 | B1 * | 11/2007 | Fain | B60D 1/62 307/10.1 |
| 7,534,108 | B1 * | 5/2009 | Wang | B60D 1/58 439/35 |
| 7,575,438 | B2 * | 8/2009 | Dilgard | H01R 13/6616 439/35 |
| 7,594,816 | B1 * | 9/2009 | Wang | B60D 1/64 439/35 |
| 7,690,950 | B2 | 4/2010 | Owen, Sr. et al. | |
| D617,284 | S | 6/2010 | Rotenberg | |
| 7,931,506 | B2 | 4/2011 | Owen, Sr. et al. | |
| 7,959,444 | B2 | 6/2011 | Corless et al. | |
| D680,080 | S | 4/2013 | Rotenberg et al. | |
| 8,845,155 | B2 * | 9/2014 | Rotenberg | H01R 13/70 307/10.8 |
| 8,932,065 | B2 * | 1/2015 | Gerling | B60D 1/64 439/35 |
| 2001/0011891 | A1 | 8/2001 | Melendez | |
| 2007/0202711 | A1 | 8/2007 | Dilgard | |
| 2008/0231285 | A1 | 9/2008 | Curtis | |
| 2009/0072619 | A1 | 3/2009 | Fudala et al. | |
| 2012/0146653 | A1 | 6/2012 | Rybolt | |

* cited by examiner

ERGONOMIC VEHICLE TRAILER ELECTRICAL CONNECTOR AND CIRCUIT INDICATOR

BACKGROUND OF THE INVENTION

1. Field of the Invention

The present invention relates generally to electrical wiring and electrical connectors. The present invention relates more specifically to an electrical connector and circuit indicator for matching the lighting and braking electrical functions of a motor vehicle with the same functionality on a towed trailer.

2. Description of the Related Art

Detachable connectors for joining the electrical circuitry on a motor vehicle with the electrical circuitry associated with a towed trailer are well known. Most motor vehicles that have been manufactured with trailer hitch components, or have been retrofit with such components, incorporate single connection points or connector plug sockets in a location adjacent the trailer hitch point. A number of efforts have been made to structure connector plugs that readily attach to and detach from the vehicle socket connector so that the user may easily connect or disconnect a trailer electrical system from that of the motor vehicle. The installed connector plug on the motor vehicle typically collects wires directed from the various lighting and braking circuitry on the motor vehicle together at the central connection point so that the electrical connections might be continued through to the hitched trailer and thereby operate the same or similar electrical systems on the trailer. For the most part, these electrical systems comprise lights, but may additionally include electrically operated wheel braking mechanisms.

Two problems frequently occur with past efforts to connect a motor vehicle electrical system with the corresponding electrical system on a towed trailer. First, the proper connections are often misidentified and crossed at the connection point, resulting in, for example, a right turn signal light being activated when a left turn signal is being made on the motor vehicle. It is important initially, therefore, that the proper association be made for the connectors at the connection point between the motor vehicle and the trailer.

A second problem that often occurs is the failure of the electrical system on the motor vehicle to properly provide voltage at the vehicle connector socket or plug. When such a problem occurs on the motor vehicle itself, the user is left wondering whether the failure of a light to operate on the trailer is due to a connection point failure or the failure of the vehicle socket to present the appropriate voltage to the connection point.

In addition to the above described problems associated with making the proper trailer electrical connection, most current connectors are structured to engage a vehicle socket or plug that is positioned beneath or adjacent the rear bumper of the vehicle in a horizontal orientation (level with the ground). In order to access this socket with a mating connector, the user must typically work at ground level and struggle to view the various wire terminals coming off of the connector inserted into the horizontal socket below the vehicle bumper. The above described connection error problems are therefore compounded by the difficulty with which most users struggle to make the proper connections while working in an uncomfortable and poor visibility position.

It would be desirable therefore to have a trailer electrical system connector that allowed the user to easily identify the various electrical circuits that are being connected, and to confirm their proper functionality. It would be desirable if such a connector could be assembled and verified with the user in a working position that lends itself to easy identification of the terminals and their functionality. It would be desirable if such connections could be made without having to operate at ground level below the bumper of the vehicle to which the connector is being attached. In addition, it would be desirable to have some indication on the connector itself as to the proper functioning of the electrical circuit that is being connected. It would be desirable that such indicators would not only identify the specific electrical circuit being worked with at a particular time, but also identify that the proper voltage is being provided at the vehicle socket or plug. It would be preferable if each of the problems described above were addressed by a trailer connector that engages standard sized connections.

SUMMARY OF THE INVENTION

The present invention provides an ergonomic vehicle trailer electrical connector and circuit indicator that facilitates the establishment of the necessary electrical connections between a motor vehicle and a towed trailer. The present invention provides a connector body having a first end portion configured in a standard arrangement appropriate for engaging a vehicle trailer connector socket or plug. A second end portion of the electrical connector defines an upwardly curved and expanded diameter cylindrical section that presents an open face work area with an array of electrical connections and an associated array of LED indicators. The upwardly curved orientation provides the user with a work area that eliminates the need to operate with the horizontal connector face at ground level and provides ease of access to each of the terminals to which trailer wires are to be attached. In addition, the upward turned face of the work area provides aligned LED indicators in an array that associates each indicator with a particular electrical terminal being connected. These LED indicators therefore provide both an identification of which particular circuit is being worked on as well as the operational functionality of that circuit, at least through to the vehicle socket or plug. Various other features and elements of the connector of the present invention allow it to operate in conjunction with standard vehicle socket or plug configurations, and to utilize various types of electrical wire connectors from the trailer electrical system. Further objects and benefits of the connector of the present invention will become apparent from consideration of the descriptions below and from the appended drawings, a brief description of which follows.

DETAILED DESCRIPTION OF THE PREFERRED EMBODIMENTS

Figure 1:
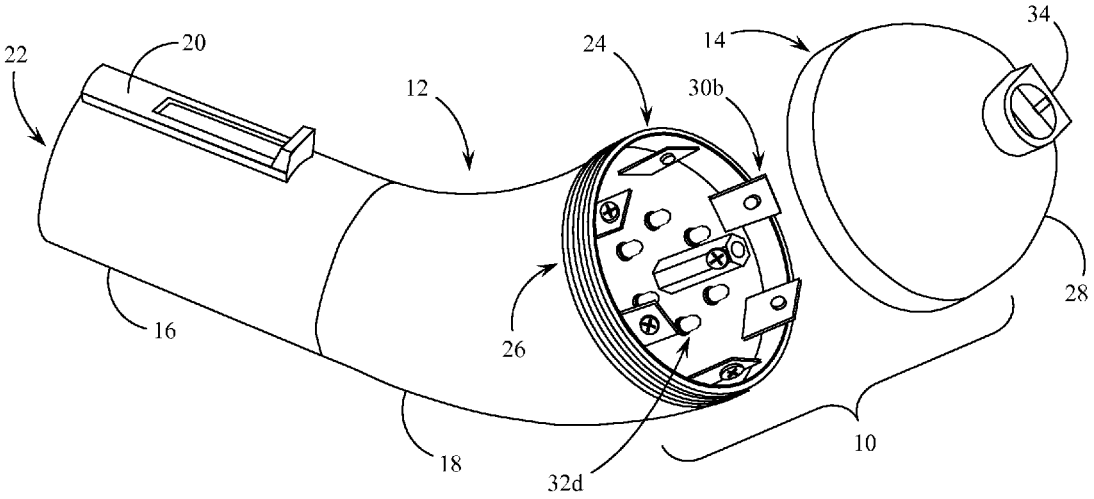
FIG. 1 is a perspective assembly view of the connector of the present invention shown adjacent the removable terminal cover.

Reference is made first to FIG. 1 for a detailed description of the trailer plug connector of the present invention. The trailer plug connector is used for completing the electrical connections required for lights, brakes, etc. on a trailer and incorporates built-in lights to confirm the operation of those electrical circuits. The structure of the trailer plug connector makes it easily accessible to the user and includes a screw-on cap or cover. The shape and orientation of the trailer plug presents the connections to the user in an ergonomic manner, reducing or eliminating the need for the user to work at ground level next to the trailer hitch in order to secure the trailer wiring components. FIG. 1 is a perspective assembly view showing both the main connector component and the removable terminal cover. Electrical connector 10 is shown to be generally made up of connector body 12 with associated terminal cover 14.

Connector body 12 is itself made up of two primary parts, connector vehicle plug body 16 and connector trailer terminal body 18. Connector vehicle plug body 16 is configured in a manner typical of trailer plugs, structured as it needs to be in order to mate with standard vehicle plug connections. Vehicle plug latch 20 is oriented at the top of the otherwise circular/cylindrical plug connection and engages with the vehicle plug (not shown in this view) to secure the plug in the socket (see FIG. 6). Connector vehicle plug face 22 provides the end of connector body 12 that engages the vehicle connection.

On an opposite end of electrical connector 10 is connector trailer terminal face 24 which is structured to receive the various electrical conductors (wires) from the trailer electrical circuitry. Terminal cover 14 attaches to connector body 12 on connector trailer terminal body 18 by way of terminal body threading 26. The cover shell 28 portion of terminal cover 14 incorporates a wire clamp 34 to gather and secure the various electrical conductors from the trailer electrical circuitry. Trailer terminals 30*a*-30*f* (all visible but not all referenced in FIG. 1) are positioned on connector trailer terminal face 24 as typically oriented for a seven conductor configuration. The six flat trailer terminals 30*a*-30*f*, typically structured with threaded apertures and attachment screws, are positioned in a radial array, equally spaced about the outer perimeter of connector trailer terminal face 24. Trailer central post terminal 31 (see also FIG. 2) is positioned in the middle of the array of trailer terminals 30*a*-30*f*. LED circuit voltage indicators 32*a*-32*f* (all visible but not all referenced in FIG. 1) are also positioned in a radial array within the array of trailer terminals 30*a*-30*f*. Each LED circuit voltage indicator is functionally associated with its nearest adjacent trailer terminal.

Figure 2:
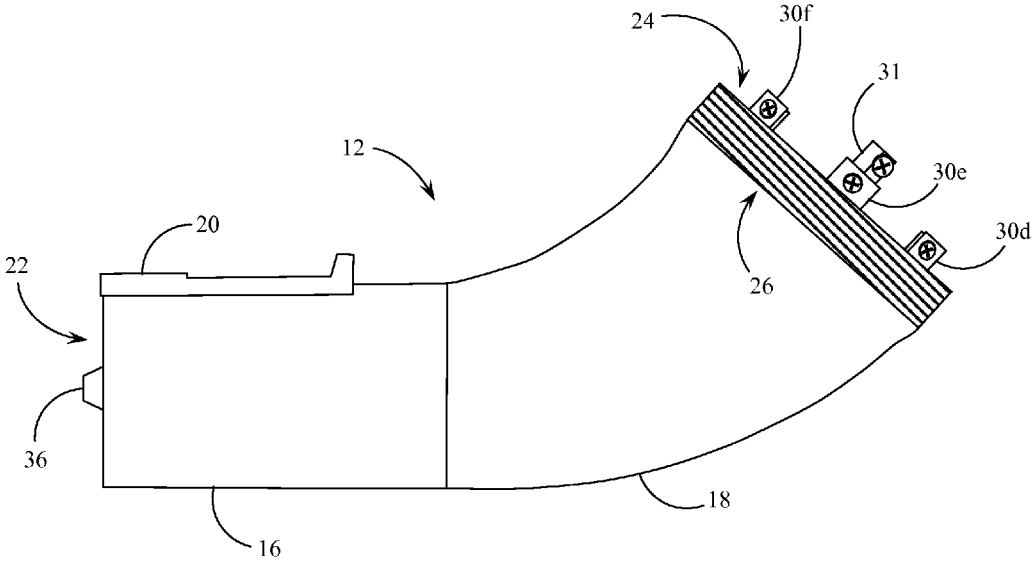
FIG. 2 is a side plan view of the main body of the connector of the present invention shown without the terminal cover and without wiring connected.

FIG. 2 is a side plan view of the main body of the connector shown without the cover and without wiring attached. In this view, connector body 12 is again shown to be made up of connector vehicle plug body 16 and connector trailer terminal body 18, the latter being positioned at an ergonomic angle with respect to the generally horizontal orientation of connector vehicle plug body 16. This ergonomic orientation presents connector trailer terminal face 24 and all of its various connections and LED indicators directly to the user in an accessible manner. Once again, connector vehicle plug body 16 is structured as is typical for trailer plug connectors with a cylindrical shape having a vehicle plug latch 20 positioned at a top orientation for engaging the vehicle socket (not shown). Connector vehicle plug face 22, described in more detail below in FIG. 3, includes primary vehicle plug center post terminal 36 that assists in the alignment of the plug with the vehicle socket connector.

Connector trailer terminal body 18, again structured as a curving cylindrical section, presents connector trailer terminal face 24 at an ergonomic angle, including the positioning of trailer terminals 30*a*-30*f* (30*d*-30*f* shown in this view) in a position that allows the user easy access to the terminals. Also accessible with this orientation is trailer center post terminal 31 positioned in the middle of connector trailer terminal face 24.

Figure 3:
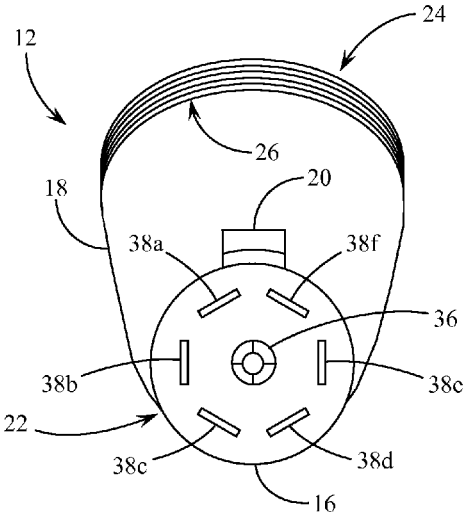
FIG. 3 is an elevational end view of the main body of the connector of the present invention as seen from the viewpoint of the vehicle side of the connector.
Figure 4:
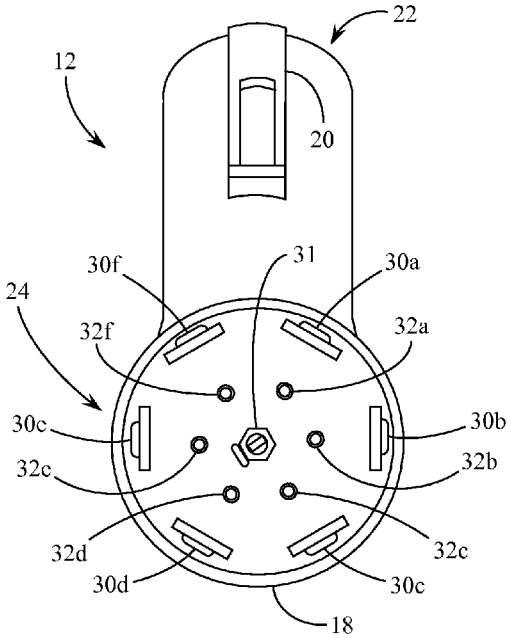
FIG. 4 is an elevational end view of the main body of the connector of the present invention as seen from the viewpoint of the trailer side of the connector.

Reference is next made to FIGS. 3 & 4 which provide elevational views of each end of the electrical connector body 12 of the present invention. FIG. 3 is an elevational view of the main body of connector 12 as seen from the vehicle viewpoint looking away from the vehicle towards the connector as it might be oriented for engagement. In this view, connector body 12 narrows to the cylindrical structure of connector vehicle plug body 16 and expands outward (towards the trailer) through the cylindrical and angled structure of connector trailer terminal body 18. Vehicle plug latch 20 is again shown positioned at the top of the circular/cylindrical structure of connector vehicle plug body 16, appropriate for engagement with a matching latch component (not shown) on the vehicle connector socket.

In FIG. 3, connector vehicle plug face 22 is shown in a profile view with each of the vehicle plug terminals 38*a*-38*f* shown arrayed about the perimeter edge of the cylindrical connector vehicle plug body 16. Centered in connector vehicle plug face 22 is vehicle plug center post terminal 36. Each of these vehicle plug terminals 38*a*-38*f*, with vehicle plug center post terminal 36, provide an electrical connection between the vehicle and the trailer as described in more detail below with respect to FIG. 5.

FIG. 4 presents the connector trailer terminal face 24 in a profile orientation as would be viewed by the user while installing and checking the operational circuitry of the electrical connector. In FIG. 4, connector body 12 is shown to taper (towards the vehicle) into the smaller cylindrical structure of connector vehicle plug body 16 with its vehicle plug latch 20 properly orienting and positioning connector vehicle plug face 22 towards the vehicle connector socket. Connector trailer terminal face 24 is shown to incorporate the circular array of trailer terminals 30*a*-30*f* (all labeled in this view) radially positioned about the perimeter of the terminal face. Centered on trailer terminal face 24 is trailer center post terminal 31.

Between center post terminal 31 and the radial array of trailer terminals 30*a*-30*f* are LED circuit voltage indicators 32*a*-32*f*. Once again, each LED is associated with the electrical circuitry defined by the nearest trailer terminal in the circular array orientation. The manner of identifying the functionality of the particular electrical circuit associated with each trailer terminal is by way of the illumination of the LED circuit voltage indicator nearest the terminal and is described in more detail below.

FIG. 4 does show the manner in which the orientation and size of connector trailer terminal body 18, with its associated connector trailer terminal face 24, offers the most convenient and easy access to each of the connection terminals and to the LED voltage indicators, such that the user may quickly and readily make the electrical connections and verify their functionality through the use of the LED indicators. Each of the trailer terminals 30*a*-30*f* is structured as a standard flat metal conductor terminal post suitable for use in conjunction with spade type electrical connectors or, through the use of threaded post attachment screws, the bare wire ends of the conductors from the trailer electrical circuitry. The object of the present invention is to provide an ergonomic presentation of the terminals and circuit functionality indicators to the user to facilitate the proper and complete attachment of the electrical conductors from the trailer circuitry to the vehicle plug and socket.

Figure 5:
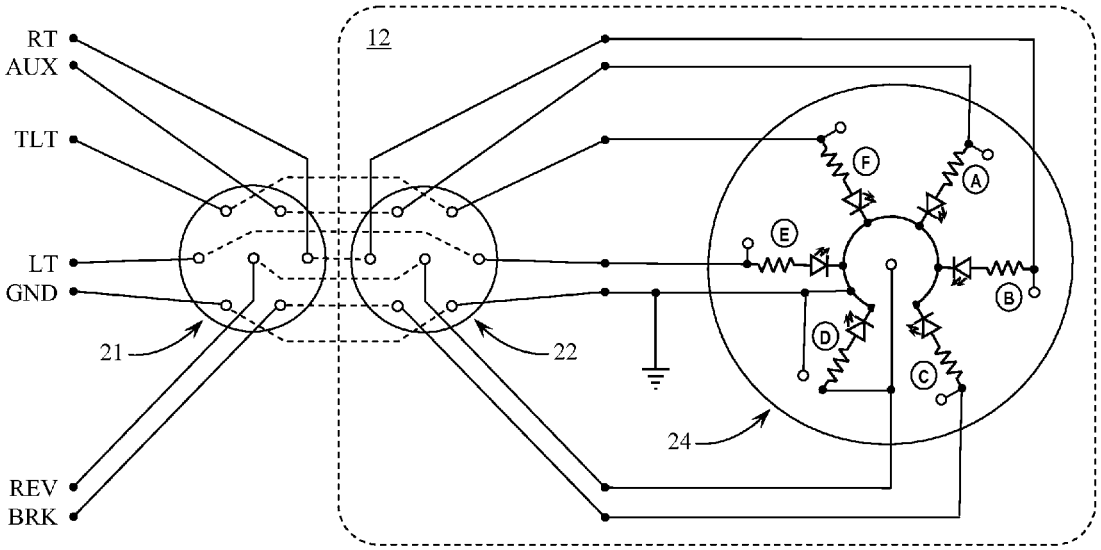
FIG. 5 is an electrical schematic diagram showing the electrical circuit connections from the vehicle through the connector of the present invention to the trailer terminal face of the present invention.

Reference is next made to FIG. 5 which is an electrical schematic diagram that shows the electrical circuit connections from the vehicle, through the connector of the present invention, to the trailer terminal face component, as described above in FIG. 4. In FIG. 5, all of the schematic components shown within broken line boundary 12 comprise all of the components within connector body 12. To the left side of the schematic, outside of the boundary of connector body 12, are the various electrical components associated with the plug/socket positioned on the vehicle itself. Vehicle socket 21 is typically a socket with male terminal posts that engage the aligned female connectors associated with connector vehicle plug face 22 positioned on connector vehicle plug body 16 (see FIG. 3). Connector vehicle plug face 22 is shown in FIG. 5 as one of the components making up the connector body 12 electrical circuitry. The remaining major component within connector body 12 is identified as connector trailer terminal face 24, which is presented in an orientation similar to that shown in FIG. 4. The orientation of the connector shown in FIG. 3 is therefore represented in the middle of FIG. 5, while the orientation of the connector shown in FIG. 4 is represented on the right side of FIG. 5. Again, the vehicle socket terminal connections are represented on the left in FIG. 5.

As described above, the detailed description of the present invention for a first preferred embodiment is directed to the typical seven conductor configuration for a vehicle trailer plug connector. The six electrical connections arranged in a circular array around a seventh center post electrical connection are typically configured in the manner described and shown in FIG. 5. These terminals are assigned on vehicle socket 21 in the following manner. The 1:00 terminal position is typically assigned to an auxiliary connection. The 3:00 position is assigned to the right turn signal and brake connection. The 5:00 position is typically assigned to the power brake electrical connection. The 7:00 position is typically configured as a terminal electrical ground. The 9:00 position is typically configured as a left turn signal and brake electrical connection. The 11:00 position is configured as a tail light electrical connection. Finally, the center terminal on the vehicle connector is typically configured as a reverse light electrical connection.

The terminals positioned on connector vehicle plug face 22 of the connector of the present invention are, of course, structured to align and mate with the electrical connections on the vehicle plug/socket itself. These electrical connections are then carried through the connector body 12, preferably with rigid conductor elements (metal bars, rods, or bands) to the appropriate point of connection on connector trailer terminal face 24. As seen in FIG. 5, these connector trailer terminal face 24 connections might be considered as generally the mirror image (horizontal symmetry) of the connections shown on the vehicle end of the connector.

In FIG. 5, electrical/electronic components make up each of the six connector circuits shown on connector trailer terminal face 24. Circuit (A), made up of terminal 30*a*, LED 32*a*, and resistor $R_A$, provides the auxiliary connection. Circuit (B), made up of terminal 30*b*, LED 32*b*, and resistor $R_B$, is the right turn signal and brake light connection for the trailer. Circuit (C), made up of terminal 30*c*, LED 32*c*, and resistor $R_C$, provides the electrical connection for the power brake system of the trailer. Circuit (D) is a slightly different electrical circuit, being make up of terminal 30*d*, which provides a ground to the trailer electrical system, but also terminal 31 (the center post), as well as LED 32*d*, and resistor $R_D$, which are positioned to identify and confirm the circuitry associated with the reverse lights on the trailer where these are utilized. Circuit (E) is made up of terminal 30*e*, LED 32*e*, and resistor $R_E$, and provides the electrical connection to the left turn signal and brake light on the trailer. Finally, Circuit (F) is made up of terminal 30*f*, LED 32*f*, and resistor $R_F$, and provides the electrical connection for the tail lights on the trailer.

Figure 6:
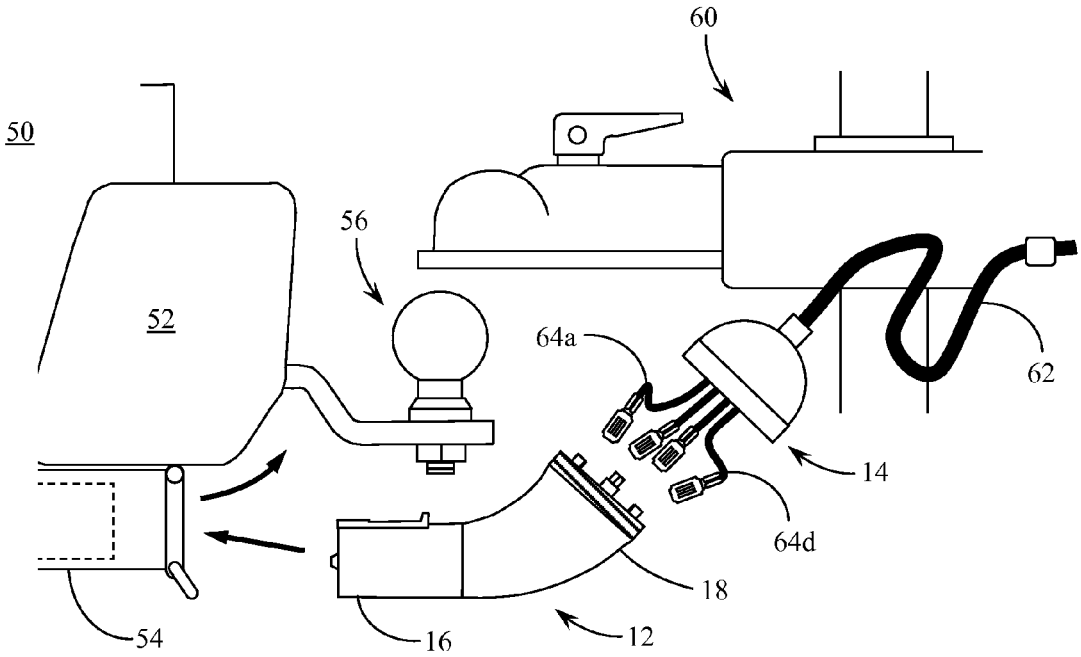
FIG. 6 is an elevational side view of the connector of the present invention with the terminal cover, shown in the process of being installed between a vehicle and a trailer.

Reference is finally made to FIG. 6, which is an elevational side view of the connector of the present invention shown in the process of installation between a vehicle and a trailer. In this view, vehicle 50 is shown with bumper 52 and hitch ball 56 configured to receive the trailer hitch component 60. The trailer electrical cable 62 generally comprises the wire bundle for the electrical circuitry associated with the trailer that comes together to be attached to the connector of the present invention. Trailer electrical cable 62 is fed through the neck of terminal cover 14 and presents the trailer electrical wires 64*a*-64*f* (not all visible or referenced in FIG. 6) for placement and positioning on the connector body 12 of the present invention. Once again, the terminal ends of the wires associated with the trailer circuitry are shown with standard spade type electrical connectors that engage the flat post connections on the connector body 12. Alternate means of connection between the wires and the connector body 12 are anticipated.

Also shown in FIG. 6 on vehicle 50, below vehicle bumper 52, is vehicle trailer connector socket 54, typically incorporating a hinged cover to protect the terminals from the elements when not in use. To use the connector of the present invention with vehicle connector socket 54, the hinged cover is opened (see directional arrows in FIG. 6) and the connector vehicle plug body portion of connector body 12 is inserted into vehicle connector socket 54 as described above. Once positioned and latched using vehicle plug latch 20, connector body 12 presents connector trailer terminal body 18 at an upward orientation appropriate for easy access by the user.

In the above described orientation, with all of the LED indicators easily visible to the user, the various connections using trailer electrical wires 64*a*-64*f* may be made. Once these connections are made and the circuit functionality of each is confirmed using the LED indicators on connector trailer terminal face 24, the terminal cover 14 may be slid down over trailer electrical cable 62 and threaded onto connector trailer terminal body 18 as described above.

Although the present invention has been described in conjunction with a number of preferred embodiments, those skilled in the art will recognize that various modifications to the described preferred embodiment may be made that still fall within the spirit and scope of the invention. In particular, the number of terminals associated with the connector may vary by as many as two or three, as there are standard configurations for five terminal connectors as well as seven or nine terminal connectors. The most common configuration is that shown and described above with the attached drawing figures.

The structure of the portion of the electrical connector of the present invention that attaches to the vehicle is relatively standard, and achieves a generally horizontal orientation because of the manner in which the vehicle socket is typically positioned on the vehicle. It is the structure of the present invention that converts this horizontal orientation to a more ergonomic orientation that makes it easier for the user to make the electrical connections and to confirm their functionality by way of the similarly oriented LED indicators. The user is immediately aware of any circuit that is non-functional by way of an LED indicator that is not illuminated during the process of making the connections. The LED indicators therefore not only provide confirmation of the functionality of the circuitry, but also confirmation of the orientation and placement of the vehicle trailer electrical conductors when initially establishing the assembly of the trailer connector.

Although specific electronic and electrical arrangements are described in FIG. 5, this description is primarily based on a standard assignment of light and brake electrical connections for most trailers. Those skilled in the art will recognize that there is no particular requirement that a given electrical conduction path be associated with a specific orientation on the electrical connector. The key elements and objectives of the present invention are to provide an easy identification of the functionality of a particular electrical conductor path, a confirmation of its being in working order, and easy access for the user to the terminal associated with that confirmed conductive path. Once again, those skilled in the art will recognize that modifications as to specific utilization of a conductive path or to the number of such electrical conductors may be made without departing from the spirit and scope of the invention.

I claim:

1. An ergonomic electrical connector and circuit indicator for connecting the electrical system of a motor vehicle to the electrical system of a trailer to be towed by the motor vehicle, the motor vehicle having a standard configuration trailer connection socket extending horizontally outward from the rear of the motor vehicle, the electrical connector and circuit indicator comprising:

a connector body comprising:

a first connector end portion structured for connection and attachment to the standard configuration trailer connection socket of the motor vehicle, the first connector end portion generally cylindrical in structure and having a central axis and a diameter, the central axis oriented generally parallel to a ground surface on which the motor vehicle is positioned when the connector body is attached to the motor vehicle; and a second connector end portion structured for connection to electrical system of the trailer being towed, the second connector end portion generally configured as a truncated circular cone and having a central axis, a first diameter generally the same as the diameter of the first connector end portion, and a second diameter larger than the first, the central axis of the second connector end portion oriented at a generally elevated angle to the central axis of the first connector end portion, the second connector end portion comprising an outward circular face having a diameter equal to the second diameter;

a plurality of electrical conductors extending through the connector body from the first connector end portion through the second connector end portion to the outward face of the second connector end portion; and a plurality of visual indicators positioned on the outward face of the second connector end portion, each one of the visual indicators electrically and physically associated with one of the plurality of electrical conductors;

wherein the outward face of the second connector end portion is presented to the user at an ergonomically convenient elevated angle to facilitate the user viewing the plurality of conductors and the plurality of visual indicators, and wherein the electrical system of the trailer is connected to the plurality of electrical conductors extending through the connector body to the outward face of the second connector end portion and the identity and electrical state of each circuit in the electrical system is indicated by the plurality of visual indicators.

2. The electrical connector and circuit indicator of claim 1 wherein the elevated angle of the central axis of the second connector end portion is in the range of 20 degrees to 70 degrees.

3. The electrical connector and circuit indicator of claim 1 wherein the plurality of electrical conductors comprise:

a first conductor extending from a forward terminal positioned generally on the central axis of the first connector end portion to a rearward terminal positioned generally on the central axis of the second connector end portion; and second through seventh conductors extending from a hexagonal radial array of forward terminals positioned generally around the forward terminal of the first conductor on the first connector end portion, to a corresponding hexagonal radial array of rearward terminals positioned generally around the rearward terminal of the first conductor.

4. The electrical connector and circuit indicator of claim 3 wherein the rearward terminal of the first conductor comprises a generally cylindrical center post terminal and the rearward terminals of the second through seventh conductors each comprise flat post terminals, each of the post terminals further comprising an attachment screw for removably connecting a conductor from the electrical system of the trailer.

5. The electrical connector and circuit indicator of claim 1 wherein the plurality of visual indicators comprise a plurality of LEDs.

6. The electrical connector and circuit indicator of claim 5 wherein one of the plurality of electrical conductors forms an electrical ground, and each of the remaining electrical conductors is connected to ground through an indicator circuit comprising one of the plurality of LEDs, wherein when a voltage is applied to a part of the electrical system of the motor vehicle, which voltage is presented at the motor vehicle trailer connection socket and there through to one of the plurality of electrical conductors, the LED associated with that electrical conductor is illuminated, thereby indicating to the user which part of the electrical system of the trailed should be connected to that electrical conductor within the connector.

7. The electrical connector and circuit indicator of claim 1 wherein the plurality of electrical conductors comprise:

a first conductor extending from a forward terminal positioned generally on the central axis of the first connector end portion to a rearward terminal positioned generally on the central axis of the second connector end portion; and second through fifth conductors extending from a rectangular array of forward terminals positioned generally around the forward terminal of the first conductor on the first connector end portion, to a corresponding rectangular array of rearward terminals positioned generally around the rearward terminal of the first conductor.

8. The electrical connector and circuit indicator of claim 7 wherein the rearward terminal of the first conductor comprises a generally cylindrical center post terminal and the rearward terminals of the second through fifth conductors each comprise flat post terminals, each of the post terminals further comprising an attachment screw for removably connecting a conductor from the electrical system of the trailer.

9. The electrical connector and circuit indicator of claim 1 wherein the plurality of electrical conductors comprise:

a first conductor extending from a forward terminal positioned generally on the central axis of the first connector end portion to a rearward terminal positioned generally on the central axis of the second connector end portion; and second through ninth conductors extending from an octagonal radial array of forward terminals positioned generally around the forward terminal of the first conductor on the first connector end portion, to a corresponding octagonal radial array of rearward terminals positioned generally around the rearward terminal of the first conductor.

10. The electrical connector and circuit indicator of claim 9 wherein the rearward terminal of the first conductor comprises a generally cylindrical center post terminal and the rearward terminals of the second through ninth conductors each comprise flat post terminals, each of the post terminals further comprising an attachment screw for removably connecting a conductor from the electrical system of the trailer.

11. The electrical connector and circuit indicator of claim 1 further comprising a removable cover attached to the second connector end portion to generally cover the outward circular face, the cover having a central aperture one or more conductors from the electrical system of the trailer.

12. The electrical connector and circuit indicator of claim 1 wherein the first connector end portion further comprises an orientation latch, the orientation latch engaging a corresponding orientation latch receiver positioned on the standard configuration trailer connection socket on the motor vehicle.

* * * * *